US010726755B2

(12) United States Patent
Liu et al.

(10) Patent No.: US 10,726,755 B2
(45) Date of Patent: Jul. 28, 2020

(54) DRIVING CIRCUIT, CONTROL METHOD THEREOF, DISPLAY PANEL AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Yuanyuan Liu, Beijing (CN); Xiaoshi Liu, Beijing (CN); Xianfeng Yuan, Beijing (CN); Hongjun Wang, Beijing (CN); Min Wang, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/332,935

(22) PCT Filed: May 31, 2018

(86) PCT No.: PCT/CN2018/089114
§ 371 (c)(1),
(2) Date: Mar. 13, 2019

(87) PCT Pub. No.: WO2019/033825
PCT Pub. Date: Feb. 21, 2019

(65) Prior Publication Data

US 2019/0228692 A1 Jul. 25, 2019

(30) Foreign Application Priority Data

Aug. 15, 2017 (CN) ..... 2017 1 0697485

(51) Int. Cl.
*G09G 3/00* (2006.01)
*G09G 3/36* (2006.01)

(52) U.S. Cl.
CPC ..... *G09G 3/006* (2013.01); *G09G 3/3677* (2013.01); *G09G 3/3696* (2013.01)

(58) Field of Classification Search
CPC .... G09G 3/006; G09G 3/3677; G09G 3/3696; G09G 2330/04; G09G 2330/12;
(Continued)

(56) References Cited

U.S. PATENT DOCUMENTS

2014/0118316 A1 5/2014 Ijima
2017/0069256 A1* 3/2017 Seo ..... G09G 3/2096
(Continued)

FOREIGN PATENT DOCUMENTS

CN 102103835 A 6/2011
CN 103794180 A 5/2014
(Continued)

OTHER PUBLICATIONS

Search Report and Written Opinion for International Application No. PCT/CN2018/089114 dated Aug. 27, 2018.
(Continued)

*Primary Examiner* — Nelson M Rosario
(74) *Attorney, Agent, or Firm* — Calfee, Halter & Griswold LLP

(57) ABSTRACT

A driving circuit, a control method thereof, a display panel, and a display device. The driving circuit comprises a logic board, a gate driving sub-circuit, and an interface control sub-circuit. The interface control sub-circuit is configured to detect a timing control signal outputted by the logic board to the gate driving sub-circuit via a signal transmission interface, and control the signal transmission interface of the logic board to stop outputting the timing control signal to the
(Continued)

gate driving sub-circuit in response to detecting that the timing control signal does not satisfy a preset condition.

19 Claims, 3 Drawing Sheets

(58) Field of Classification Search
CPC ..... G09G 3/36; G09G 2310/0286; G09G 2310/0291; G09G 2310/08; G09G 2330/021; G11C 19/28
See application file for complete search history.

(56) References Cited

U.S. PATENT DOCUMENTS

| | | | | |
|---|---|---|---|---|
| 2017/0116943 | A1 | 4/2017 | Zhang et al. | |
| 2018/0174542 | A1* | 6/2018 | Zheng ..... | G09G 3/3677 |
| 2019/0228692 | A1 | 7/2019 | Liu et al. | |

FOREIGN PATENT DOCUMENTS

| | | | |
|---|---|---|---|
| CN | 105185346 | A | 12/2015 |
| CN | 105679230 | A | 6/2016 |
| CN | 106023931 | A | 10/2016 |
| CN | 106228944 | A | 12/2016 |
| CN | 107424578 | A | 12/2017 |
| JP | 2009058685 | A | 3/2009 |

OTHER PUBLICATIONS

First Office Action for Chinese Patent Application No. 201710697485.8 dated Feb. 28, 2019.

* cited by examiner

DRIVING CIRCUIT, CONTROL METHOD THEREOF, DISPLAY PANEL AND DISPLAY DEVICE

RELATED APPLICATION

The present application is the U.S. national phase entry of PCT/CN2018/089114, with an international filing date of May 31, 2018, which claims the benefit of Chinese Patent Application No. 201710697485.8, filed on Aug. 15, 2017, the entire disclosure of which is incorporated herein by reference.

FIELD

The present disclosure relates to the field of display technologies, and particularly to a driving circuit, a control method thereof, a display panel and a display device.

BACKGROUND

An existing liquid crystal display device, such as a television, a monitor, a notebook, and the like, mainly comprises components such as a signal system, a logic board, a gate driving sub-circuit, an array substrate, a color filter substrate, etc. The gate driving sub-circuit is used for controlling a gate voltage of a thin film transistor on the array substrate to thereby control ON and OFF of the thin film transistor. The signal system is used for providing a control signal to a liquid crystal display panel. Specifically, a control signal sent by the signal system is transmitted to the logic board, and after the logic board finishes processing the control signal, a processed control signal is transmitted to the gate driving sub-circuit.

The control signal sent by the signal system typically includes a power supply signal, an image signal, a timing control signal, etc. When the image signal is abnormal or the timing control signal is abnormal, an abnormal control signal is liable to cause damage to the gate driving sub-circuit. Conventionally, when the image signal is abnormal, the liquid crystal display panel will go into a self-protection mode, in which the logic board does not receive the control signal sent by the signal system, but will generate a corresponding control signal and send it to the gate driving sub-circuit. For example, the logic board generates a full-black image signal, a certain grayscale image signal, and the like to thereby prevent the abnormal image signal from adversely affecting the gate driving sub-circuit. When the timing control signal is abnormal, the logic board of the liquid crystal display panel generally performs no processing, or performs processing in the same way as that in the case of an abnormal image signal. The above two ways of processing an abnormal control signal both enable the gate driving sub-circuit to still operate in case the control signal is abnormal. However, the gate driving sub-circuit is easily damaged if it is in an abnormal operating state for a long time, which in turn results in abnormal display in the liquid crystal display panel.

SUMMARY

An exemplary embodiment of the present disclosure provides a driving circuit comprising a logic board, a gate driving sub-circuit, and an interface control sub-circuit. The interface control sub-circuit is configured to detect a timing control signal outputted by the logic board to the gate driving sub-circuit via a signal transmission interface, and control the signal transmission interface of the logic board to stop outputting the timing control signal to the gate driving sub-circuit in response to detecting that the timing control signal does not satisfy a preset condition.

According to some embodiments of the present disclosure, the timing control signal is a clock signal, and the interface control sub-circuit is configured to detect the clock signal outputted by the logic board to the gate driving sub-circuit via the signal transmission interface, and control the signal transmission interface of the logic board to stop outputting the clock signal to the gate driving sub-circuit in response to detecting that the clock signal does not satisfy a preset signal frequency range.

According to some embodiments of the present disclosure, the interface control sub-circuit comprises a detection circuit unit and a protection circuit unit. The detection circuit unit is configured to detect a signal frequency of the clock signal outputted by the logic board to the gate driving sub-circuit via the signal transmission interface, and send a detected signal frequency to to the protection circuit unit. The protection circuit unit is configured to determine whether the signal frequency of the received clock signal satisfies the preset signal frequency range, and control the signal transmission interface of the logic board to stop outputting the clock signal to the gate driving sub-circuit in response to the signal frequency of the clock signal not satisfying the preset signal frequency range.

According to some embodiments of the present disclosure, the detection circuit unit comprises a period detector and a frequency calculator. The period detector is configured to detect a signal period of a row starting signal outputted by the logic board to the gate driving sub-circuit via the signal transmission interface. The frequency calculator is configured to calculate the signal frequency of the clock signal according to the signal period of the row starting signal detected by the period detector, and send a calculated signal frequency to the protection circuit unit.

According to some embodiments of the present disclosure, the signal frequency of the clock signal is equal to a screen resolution of a display panel in which the driving circuit is used divided by the signal period of the row starting signal detected by the period detector.

According to some embodiments of the present disclosure, the preset signal frequency range is [25 MHz, 110 MHz].

Another exemplary embodiment of the present disclosure provides a display panel comprising any of the driving circuits described above.

A further exemplary embodiment of the present disclosure provides a display device comprising any of the display panels described above.

Yet another exemplary embodiment of the present disclosure provides a control method for any of the driving circuits described above, comprising: detecting, by the interface control sub-circuit, a timing control signal outputted by the logic board to the gate driving sub-circuit via the signal transmission interface; controlling, by the interface control sub-circuit, the to signal transmission interface of the logic board to stop outputting the timing control signal to the gate driving sub-circuit in response to detecting that the timing control signal does not satisfy a preset condition.

According to some embodiments of the present disclosure, said detecting, by the interface control sub-circuit, a timing control signal outputted by the logic board to the gate driving sub-circuit via the signal transmission interface includes: detecting, by the interface control sub-circuit, a signal frequency of the clock signal outputted by the logic board to the gate driving sub-circuit via the signal transmission interface.

According to some embodiments of the present disclosure, said detecting, by the interface control sub-circuit, a signal frequency of the clock signal outputted by the logic board to the gate driving sub-circuit via the signal transmission interface includes: determining, by the interface control sub-circuit, whether the detected signal frequency of the clock signal satisfies the preset signal frequency range.

According to some embodiments of the present disclosure, said controlling, by the interface control sub-circuit, the signal transmission interface of the logic board to stop outputting the timing control signal to the gate driving sub-circuit in response to detecting that the timing control signal does not satisfy a preset condition includes: controlling, by the interface control sub-circuit, the signal transmission interface of the logic board to stop outputting the clock signal to the gate driving sub-circuit in response to the detected signal frequency of the clock signal not satisfying the preset signal frequency range.

According to some embodiments of the present disclosure, said detecting, by the interface control sub-circuit, a signal frequency of the clock signal outputted by the logic board to the gate driving sub-circuit via the signal transmission interface includes: detecting, by the interface control sub-circuit, a signal period of a row starting signal outputted by the logic board to the gate driving sub-circuit via the signal transmission interface; and calculating the signal frequency of the clock signal based on the detected signal period of the row starting signal.

According to some embodiments of the present disclosure, said calculating the signal frequency of the clock signal based on the detected signal period of the row starting signal includes: dividing a screen resolution of a display panel in which the driving circuit is used by the detected signal period of the row starting signal, and taking a resulting value as the signal frequency of the clock signal.

According to some embodiments of the present disclosure, the preset signal frequency range is [25 MHz, 110 MHz].

DETAILED DESCRIPTION

Figure 1:
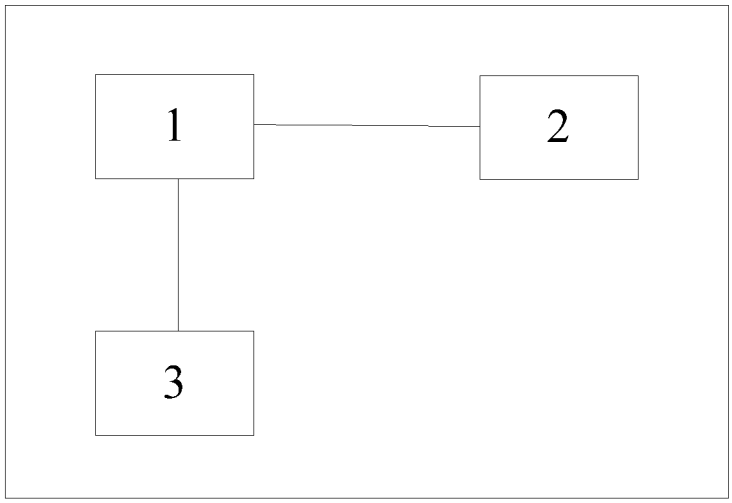
FIG. 1 is a structural block diagram of a driving circuit provided by an embodiment of the present disclosure.

To make the above objective, features and advantages of the present disclosure more apparent and comprehensible, the present disclosure is further described in detail below in conjunction with the accompanying drawings and specific embodiments.

In the description of the present disclosure, the meaning of "a plurality" is two or more, unless otherwise stated. The orientational or positional relationships indicated by the terms such as "upper", "lower", "left", "right", "inside", "outside" and the like are based on those shown in the drawings, and the terms are merely intended to facilitate description of the present disclosure and simplify the description, rather than indicating or implying that the component or element referred to must have a specific orientation, or be constructed and manufactured in a specific orientation, and are therefore not to be construed as limiting the present disclosure.

In the description of the present disclosure, it is to be noted that the term "install", "link" or "connect" should be understood in a broad sense, unless otherwise specified and defined explicitly, which may be, for example, a fixed connection, a detachable connection, or an integral connection; a mechanical connection or an electrical connection; a direct connection or an indirect connection via an intermediate medium. Specific meanings of the above terms in the present disclosure may be understood by those ordinarily skilled in the art based on specific situations.

Implementations of the present disclosure are further described in detail below with reference to the accompanying drawings and embodiments. The following embodiments are intended to illustrate the present disclosure, rather than limit the scope of the present disclosure.

FIG. 1 is a block diagram of a driving circuit provided by an embodiment of the present disclosure. The driving circuit shown in FIG. 1 comprises a logic board 1, a gate driving sub-circuit 2, and an interface control sub-circuit 3.

The logic board 1 is also referred to as a screen driver board or a TCON board, and is configured to convert a received low-voltage differential signaling (LVDS) image data input signal into a timing control signal capable of driving a display screen, and then transmit a processed timing control signal to an LVDS receiving chip of the display screen. The logic board 1 is provided with a signal transmission interface (I/O interface) so as to transmit or receive signals or data through the signal transmission interface. The I/O interface is internally provided with a number of special registers and corresponding control logic circuits. The interface control sub-circuit 3 can control the I/O interface of the logic board 1 to be turned on and turned off by sending an instruction to the I/O interface of the logic board 1, thereby achieving control over a signal transmission of the logic board.

The gate driving sub-circuit 2 is configured to receive a timing control signal after being processed by the logic board 1, and control the operating state of a thin film transistor in the display screen according to the received timing control signal.

The interface control sub-circuit 3 is configured to detect a timing control signal outputted by the logic board 1 to the gate driving sub-circuit 2 via the signal transmission interface, and control the signal transmission interface of the logic board 1 to stop outputting the timing control signal to the gate driving sub-circuit 2 in response to detecting that the timing control signal does not satisfy a preset condition. When the timing control signal satisfies the preset condition, the interface control sub-circuit 3 can control the signal transmission interface of the logic board 1 to operate normally to output the timing control signal to the gate driving sub-circuit 2.

After determining that the timing control signal inputted by the logic board 1 to the gate driving sub-circuit 2 is abnormal, the interface control sub-circuit 3 can stop outputting the timing control signal to the gate driving sub-circuit 2 by controlling the signal transmission interface of the control logic board 1 to be turned off, so that the gate driving sub-circuit 2 does not operate when the timing control signal is abnormal, which thus protects the safety of the gate driving sub-circuit 2, realizes automatic protection of a display panel mounted with the driving circuit, and guarantees the life times of the driving circuit, the display panel and the display device.

After finishing the detection and determination of the current timing control signal and performing the corresponding control operation, the interface control sub-circuit 3 may continue to detect and determine a next timing control signal to thereby control the signal transmission interface of the logic board 1 during the transmission of the timing control signal, and accordingly control the gate driving sub-circuit 2. When it is detected that the timing control signal is abnormal, the signal transmission interface of the control logic board 1 is turned off, so that the gate driving sub-circuit 2 stops operating. Then, if it is detected that the timing control signal becomes normal, the signal transmission interface of the logic board 1 can be controlled to be turned on, so that the gate driving sub-circuit 2 resumes operation.

Upon implementation, the interface control sub-circuit 3 may be separately integrated on a chip, or integrated on the logic board 1, or integrated on other chips in the driving circuit. In fact, the position where the interface sub-circuit 3 is integrated may be set as needed.

The timing control signal inputted by the logic board 1 to the gate driving sub-circuit 2 may include various types, and different types of timing control signals may correspond to different preset conditions.

Figure 2:
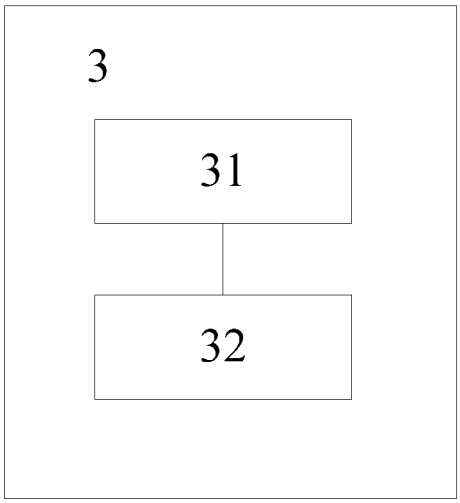
FIG. 2 is a structural block diagram of an interface control sub-circuit in a driving circuit provided by an embodiment of the present disclosure.

For example, the timing control signal may be a clock signal. Correspondingly, if the signal frequency of the clock signal inputted by the logic board 1 to the gate driving sub-circuit 2 is too large, the screen-displayed content is refreshed too fast, which will cause damage to the gate driving sub-circuit 2 and other devices. If the signal frequency of the clock signal inputted by the logic board 1 to the gate driving sub-circuit 2 is too small, the screen-displayed content is refreshed too slowly, which will affect display of the content on the screen, and also cause damage to devices of the liquid crystal screen. Therefore, when the timing control signal is a to clock signal, the preset condition may be a signal frequency range of the clock signal. In this case, the interface control sub-circuit 3 may be particularly configured to detect a clock signal outputted by the logic board 1 to the gate driving sub-circuits 2 via the signal transmission interface, and control the signal transmission interface of the control logic board 1 to stop outputting the clock signal to the gate driving sub-circuit 2 in response to detecting that the clock signal does not satisfy a preset signal frequency range In an exemplary embodiment, as shown in FIG. 2, the interface control sub-circuit 3 may comprise a detection circuit unit 31 and a protection circuit unit 32. The detection circuit unit 31 is configured to detect a signal frequency of the clock signal outputted by the logic board 1 to the gate driving sub-circuit 2 via the signal transmission interface, and transmit the detected signal frequency to the protection circuit unit 32. The protection circuit unit 32 is configured to determine whether the signal frequency of the received clock signal satisfies a preset signal frequency range, and control the signal transmission interface of the logic board 1 to stop outputting the clock signal to the gate driving sub-circuit 2 in response to the signal frequency of the received clock signal not satisfying the preset signal frequency range.

Figure 3:
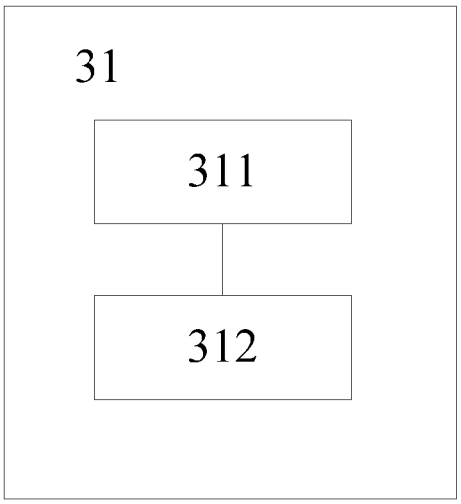
FIG. 3 is a structural block diagram of a detection circuit unit in a driving circuit provided by an embodiment of the present disclosure.

When the signal inputted by the logic board 1 to the gate driving sub-circuit 2 is an STV signal rather than a clock signal, the signal frequency of the used clock signal is obtained by conversion based on the signal period of the STV signal, wherein the STV signal is a row starting signal. In this case, as shown in FIG. 3, the detection circuit unit 31 may include a period detector 311 and a frequency calculator 312, wherein the period detector 311 is configured to detect the signal period of the STV signal outputted by the logic board 1 to the gate driving sub-circuit 2 via the signal transmission interface, and the frequency calculator 312 is configured to calculate the signal frequency of the clock signal based on the signal period of the STV signal detected by the period detector 311, and transmit the calculated signal to frequency to the protection circuit unit 32.

When the frequency calculator 312 calculates the signal frequency of the clock signal based on the signal period of the STV signal, specifically, a screen resolution of the display panel may be divided by the signal period of the STV signal detected by the period detector 311, and a resulting value is used as the signal frequency of the clock signal. Assuming that the signal period of the STV signal detected by the STV period detection circuit unit 31 is T, the signal frequency of the clock signal is $f_{clk}$, and the screen resolution of the display panel is SR (Screen Resolution), $f_{clk}$=SR/T.

By analyzing the structures and functions described above, it can be known that the driving circuit provided by an embodiment of the present disclosure is able to, when the signal frequency of the clock signal is abnormal, control the signal transmission interface of the logic board to be turned off to thereby stop outputting the clock signal to the gate driving sub-circuit, and accordingly stop operation of the gate driving sub-circuit, thereby protecting the safety of the gate driving sub-circuit when the signal frequency of the clock signal is abnormal.

An embodiment of the present disclosure further provides a display panel comprising the driving circuit provided by an embodiment of the present disclosure. Since the display panel comprises the driving circuit, it has the advantages of the driving circuit. For the advantages of the display panel, no detailed description will be made in embodiments of the present disclosure.

An embodiment of the present disclosure further provides a display device comprising the display panel provided by an embodiment of the present disclosure. Since the display device comprises the display panel, it has the advantages of the display panel. For the advantages of the display device, no detailed description will be made in embodiments of the present disclosure.

Figure 4:
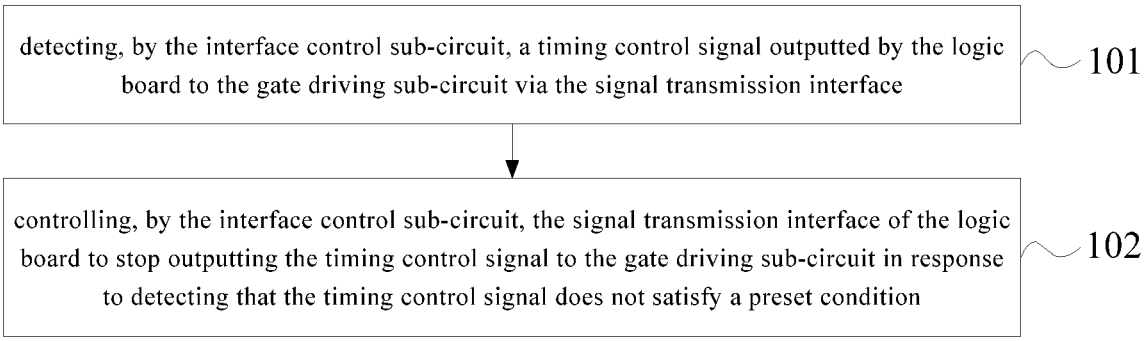
FIG. 4 is a flow chart of a control method for a driving circuit provided an embodiment of the present disclosure.

An embodiment of the present disclosure further provides a control method for the driving circuit described above. FIG. 4 is a flow chart of a control method for a driving circuit provided by an embodiment of the present disclosure. Referring to FIG. 4, the control method for a driving circuit comprises: at step 101, detecting, by the interface control sub-circuit, a timing control signal outputted by the logic board to the gate driving sub-circuit via the signal transmission interface; and at step 102, controlling, by the interface control sub-circuit, the signal transmission interface of the logic board to stop outputting the timing control signal to the gate driving sub-circuit in response to detecting that the timing control signal does not satisfy a preset condition.

After determining that the timing control signal inputted by the logic board to the gate driving sub-circuit is abnormal, the signal transmission interface of the logic board is controlled by the interface control sub-circuit to be turned off so as to stop outputting the timing control signal to the gate driving sub-circuit, so that the gate driving sub-circuit does not operate when the timing control signal is abnormal, which thus protects the safety of the gate driving sub-circuit, guarantees the life time of the driving circuit, and further guarantees the life times of the display panel and the display device mounted with the driving circuit.

When the timing control signal transmitted from the logic board to the gate driving sub-circuit is a clock signal, the step of detecting, by the interface control sub-circuit, a timing control signal outputted by the logic board to the gate driving sub-circuit via the signal transmission interface may specifically include: detecting, by the interface control sub-circuit, a signal frequency of the clock signal outputted by the logic board to the gate driving sub-circuit via the signal transmission interface.

In this case, the step of controlling, by the interface control sub-circuit, the signal transmission interface of the logic board to stop outputting the timing control signal to the gate driving sub-circuit in response to detecting to that the timing control signal does not satisfy a preset condition may include: controlling, by the interface control sub-circuit, the signal transmission interface of the logic board to stop outputting the clock signal to the gate driving sub-circuit in response to detecting that the signal frequency of the clock signal does not satisfy a preset signal frequency range.

Further, the step of detecting, by the interface control sub-circuit, a signal frequency of the clock signal outputted by the logic board to the gate driving sub-circuit via the signal transmission interface may include: determining, by the interface control sub-circuit, whether the detected signal frequency of the clock signal satisfies a preset signal frequency range. Further, the step of controlling, by the interface control sub-circuit, the signal transmission interface of the logic board to stop outputting the timing control signal to the gate driving sub-circuit in response to detecting that the timing control signal does not satisfy a preset condition may include:

controlling, by the interface control sub-circuit, the signal transmission interface of the logic board to stop outputting the clock signal to the gate driving sub-circuit in response to the detected signal frequency of the clock signal not satisfying the preset signal frequency range.

When the signal inputted by the logic board to the gate driving sub-circuit is an STV signal, the step of detecting, by the interface control sub-circuit, a signal frequency of the clock signal outputted by the logic board to the gate driving sub-circuit via the signal transmission interface may include: detecting, by the interface control sub-circuit, a signal period of the STV signal outputted by the logic board to the gate driving sub-circuit via the signal transmission interface; and calculating a signal frequency of the clock signal based on the detected signal period of the STV signal.

Further, the step of calculating a signal frequency of the clock signal based on the detected signal period of the STV signal may include: dividing the screen resolution of the display panel by the detected signal period of the STV signal, and using a resulting value as the signal frequency of the clock signal.

By using the control method for a driving circuit provided by an embodiment of the present disclosure, when the signal frequency of the clock signal is abnormal, the signal transmission interface of the logic board can be controlled to be turned off to stop outputting the clock signal to the gate driving sub-circuit, and the gate driving sub-circuit accordingly stops operating, which thus protects the safety of the gate driving sub-circuit when the signal frequency of the clock signal is abnormal.

In order to enable the control method for a driving circuit provided by an embodiment of the present disclosure to be understood by those skilled in the art more clearly, the control method for a driving circuit provided by an embodiment of the present disclosure will be described in detail by means of the examples below.

Figure 5:
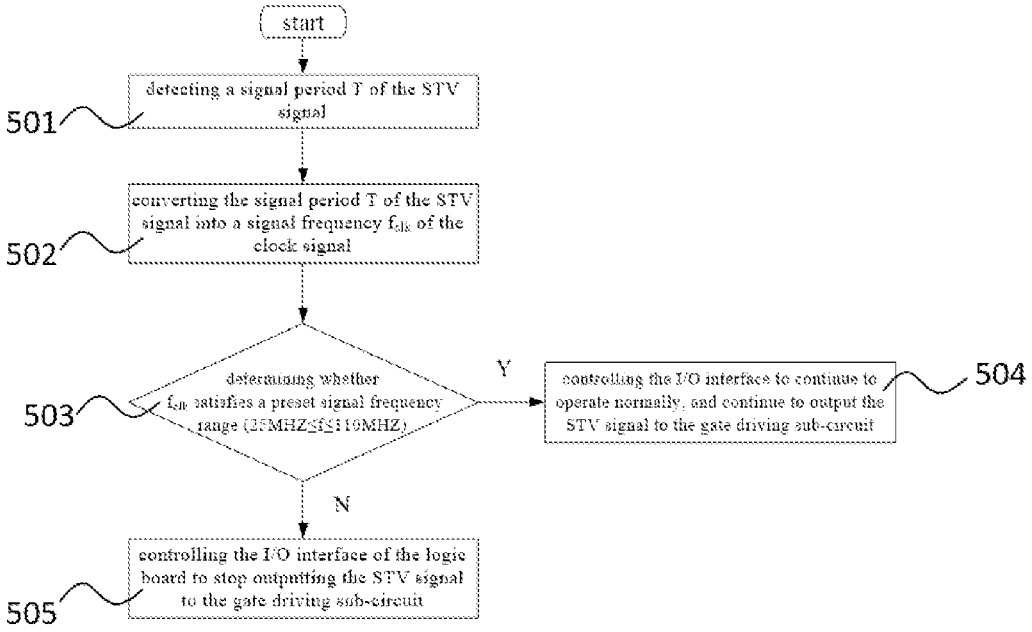
FIG. 5 is a control flow of a driving circuit provided by an embodiment of the present disclosure.

FIG. 5 is a flow of the control method for a driving circuit provided by an embodiment of the present disclosure. As shown in FIG. 5, firstly in step 501, a signal period T of the STV signal inputted by the logic board to the gate driving sub-circuit is detected. Next, in step 502, the signal period T of the STV signal is converted into a signal frequency $f_{clk}$ of the clock signal. Then, in step 503, it is determined whether the calculated signal frequency $f_{clk}$ satisfies a preset signal frequency range (for example, 25 MHZ≤f≤110 MHZ). If it does (Y branch), in step 504, the signal transmission interface (I/O interface) of the logic board is controlled to output the STV signal to the gate driving sub-circuit; otherwise (N branch), in step 505, the signal transmission interface (I/O interface) of the logic board is controlled by the gate driving sub-circuit to be turned off to stop outputting the STV signal to the gate driving sub-circuit, so that the gate driving sub-circuit stops operating.

After finishing the detection and determination of the signal period T of the current STV signal, the signal period T of a next STV signal inputted by to the logic board to the gate driving sub-circuit continues to be detected and determined, and the above multiple steps are repeatedly performed.

Various embodiments in this specification are described in a progressive manner, each embodiment focuses on its differences from other embodiments, and the same or similar parts between the various embodiments may be referred to each other.

The driving circuit, the display panel, the display device and the control method thereof provided by the present disclosure have been described above in detail. The principles and implementations of the present disclosure are described herein by applying specific examples. The above description of embodiments only helps to understand the method of the present disclosure and the core concept thereof. Meanwhile, for those ordinarily skilled in the art, implementations and application ranges will vary based on the concept of the present disclosure. In summary, the contents of this specification should not be construed as limiting the present disclosure.

The invention claimed is:

1. A driving circuit comprising a logic board, a gate driving sub-circuit, and an interface control sub-circuit, wherein the interface control sub-circuit is configured to detect a timing control signal outputted by the logic board to the gate driving sub-circuit via a signal transmission interface, and control the signal transmission interface of the logic board to stop outputting the timing control signal to the gate driving sub-circuit in response to detecting that the timing control signal does not satisfy a preset condition; and wherein the timing control signal is a clock signal, and the interface control sub-circuit is configured to detect the clock signal outputted by the logic board to the gate driving sub-circuit via the signal transmission interface, and control the signal transmission interface of the logic board to stop outputting the clock signal to the gate driving sub-circuit in response to detecting that the clock signal does not satisfy a preset signal frequency range.

2. The driving circuit according to claim 1, wherein the interface control sub-circuit comprises a detection circuit unit and a protection circuit unit, the detection circuit unit being configured to detect a signal frequency of the clock signal outputted by the logic board to the gate driving sub-circuit via the signal transmission interface, and send a detected signal frequency to the protection circuit unit, the protection circuit unit being configured to determine whether the signal frequency of a received clock signal satisfies the preset signal frequency range, and control the signal transmission interface of the logic board to stop outputting the clock signal to the gate driving sub-circuit in response to the signal frequency of the clock signal not satisfying the preset signal frequency range.

3. The driving circuit according to claim 2, wherein the detection circuit unit comprises a period detector and a frequency calculator, the period detector being configured to detect a signal period of a row starting signal outputted by the logic board to the gate driving sub-circuit via the signal transmission interface, the frequency calculator being configured to calculate the signal frequency of the clock signal according to the signal period of the row starting signal detected by the period detector, and send a calculated signal frequency to the protection circuit unit.

4. The driving circuit according to claim 3, wherein the signal frequency of the clock signal is equal to a screen resolution of a display panel in which the driving circuit is used divided by the signal period of the row starting signal detected by the period detector.

5. The driving circuit according to claim 1, wherein the preset signal frequency range is [25 MHz, 110 MHz].

6. A display panel comprising the driving circuit according to claim 1.

7. A display device comprising the display panel according to claim 6.

8. The display panel according to claim 6, wherein the timing control signal is a clock signal, and the interface control sub-circuit is configured to detect the clock signal outputted by the logic board to the gate driving sub-circuit via the signal transmission interface, and control the signal transmission interface of the logic board to stop outputting the clock signal to the gate driving sub-circuit in response to detecting that the clock signal does not satisfy a preset signal frequency range.

9. The display panel according to claim 8, wherein the interface control sub-circuit comprises a detection circuit unit and a protection circuit unit, the detection circuit unit being configured to detect a signal frequency of the clock signal outputted by the logic board to the gate driving sub-circuit via the signal transmission interface, and send a detected signal frequency to the protection circuit unit, the protection circuit unit being configured to determine whether the signal frequency of a received clock signal satisfies the preset signal frequency range, and control the signal transmission interface of the logic board to stop outputting the clock signal to the gate driving sub-circuit in response to the signal frequency of the clock signal not satisfying the preset signal frequency range.

10. The display panel according to claim 9, wherein the detection circuit unit comprises a period detector and a frequency calculator, the period detector being configured to detect a signal period of a row starting signal outputted by the logic board to the gate driving sub-circuit via the signal transmission interface, the frequency calculator being configured to calculate the signal frequency of the clock signal according to the signal period of the row starting signal detected by the period detector, and send a calculated signal frequency to the protection circuit unit.

11. The display panel according to claim 10, wherein the signal frequency of the clock signal is equal to a screen resolution of the display panel in which the driving circuit is used divided by the signal period of the row starting signal detected by the period detector.

12. The display panel according to claim 8, wherein the preset signal frequency range is from 25 MHz to 110 MHz.

13. A control method for the driving circuit according to claim 1, comprising: detecting, by the interface control sub-circuit, the timing control signal outputted by the logic board to the gate driving sub-circuit via the signal transmission interface; controlling, by the interface control sub-circuit, the signal transmission interface of the logic board to stop outputting the timing control signal to the gate driving sub-circuit in response to detecting that the timing control signal does not satisfy a preset condition.

14. The control method according to claim 13, wherein said detecting, by the interface control sub-circuit, the timing control signal outputted by the logic board to the gate driving sub-circuit via the signal transmission interface includes: detecting, by the interface control sub-circuit, a signal frequency of a clock signal outputted by the logic board to the gate driving sub-circuit via the signal transmission interface.

15. The control method according to claim 14, wherein said detecting, by the interface control sub-circuit, the signal frequency of the clock signal outputted by the logic board to the gate driving sub-circuit via the signal transmission interface includes: determining, by the interface control sub-circuit, whether the detected signal frequency of the clock signal satisfies a preset signal frequency range.

16. The control method according to claim 15, wherein said controlling, by the interface control sub-circuit, the signal transmission interface of the logic board to stop outputting the timing control signal to the gate driving sub-circuit in response to detecting that the timing control signal does not satisfy a preset condition includes: controlling, by the interface control sub-circuit, the signal transmission interface of the logic board to stop outputting the clock signal to the gate driving sub-circuit in response to detecting that the signal frequency of the clock signal does not satisfy the preset signal frequency range.

17. The control method according to claim 15, wherein the preset signal frequency range is [25 MHz, 110 MHz].

18. The control method according to claim 14, wherein said detecting, by the interface control sub-circuit, the signal frequency of the clock signal outputted by the logic board to the gate driving sub-circuit via the signal transmission interface includes: detecting, by the interface control sub-circuit, a signal period of a row starting signal outputted by the logic board to the gate driving sub-circuit via the signal transmission interface; and calculating the signal frequency of the clock signal based on the detected signal period of the row starting signal.

19. The control method according to claim 18, wherein said calculating the signal frequency of the clock signal based on the detected signal period of the row starting signal includes: dividing a screen resolution of a display panel in which the driving circuit is used by the detected signal period of the row starting signal, and taking a resulting value as the signal frequency of the clock signal.

* * * * *